US007661395B2

(12) United States Patent
Watanabe et al.

(10) Patent No.: US 7,661,395 B2
(45) Date of Patent: Feb. 16, 2010

(54) STROKE-VARIABLE ENGINE

(75) Inventors: Sei Watanabe, Saitama (JP); Shohei Kono, Saitama (JP); Gaku Naoe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/507,015

(22) Filed: Aug. 21, 2006

(65) Prior Publication Data

US 2007/0044740 A1 Mar. 1, 2007

(30) Foreign Application Priority Data

Aug. 29, 2005 (JP) ..... 2005-247796

(51) Int. Cl.
*F02D 15/02* (2006.01)

(52) U.S. Cl. ..... 123/48 B

(58) Field of Classification Search ..... 123/143 B, 123/97 AC, 48 D, 78 F, 78 E, 48 B
See application file for complete search history.

(56) References Cited

U.S. PATENT DOCUMENTS

| | | | | |
|---|---|---|---|---|
| 4,517,931 | A | 5/1985 | Nelson | |
| 5,335,632 | A * | 8/1994 | Hefley | 123/48 B |
| 6,561,142 | B2 * | 5/2003 | Moteki et al. | 123/48 B |
| 6,622,670 | B2 * | 9/2003 | Hiyoshi et al. | 123/48 B |
| 2002/0144665 | A1 * | 10/2002 | Ushijima et al. | 123/48 B |

FOREIGN PATENT DOCUMENTS

| | | |
|---|---|---|
| JP | 9-228858 A | 9/1997 |
| JP | 2002-129995 | 5/2002 |
| JP | 2003-314237 | 11/2003 |
| JP | 20040332169 | 11/2004 |
| KR | 1020030082450 | 11/2003 |

* cited by examiner

*Primary Examiner*—Stephen K Cronin
*Assistant Examiner*—Keith Coleman
(74) *Attorney, Agent, or Firm*—Arent Fox LLP

(57) ABSTRACT

In a stroke-variable engine, the position of a center of gravity of a subsidiary connecting rod is determined so that a distance between the position of the center of gravity of the subsidiary connecting rod and an axis of a crankpin is smaller than a distance between a point of connection of a main connecting rod to the subsidiary connecting rod and the position of the center of gravity as well as a distance between a point of connection of a control rod to the subsidiary connecting rod and the position of the center of gravity. Thus, 0.5-order vibration generated in the subsidiary connecting rod is lowered, engine vibration is suppressed, and noise generated with the vibration is suppressed.

2 Claims, 5 Drawing Sheets

STROKE-VARIABLE ENGINE

RELATED APPLICATION DATA

The present invention is based upon Japanese priority application No. 2005-247796, which is hereby incorporated in its entirety herein by reference.

BACKGROUND OF THE INVENTION

1. Field of the Invention

The present invention relates to a stroke-variable engine, and particularly to an improvement in a stroke-variable engine comprising: a main connecting rod connected at one end to a piston through a piston pin; a subsidiary connecting rod which is connected to a crankpin of a crankshaft rotatably supported in a crankcase of an engine body and which is connected to the other end of the main connecting rod; a control rod connected at one end to the subsidiary connecting rod at a position offset from a connected position of the main connecting rod; and a pivot shaft which is rotated about an eccentric axis by a power transmitted at a reduction ratio of 1/2 from the crankshaft and to which the other end of the control rod is connected.

2. Description of the Related Art

Such a stroke-variable engine is already known, for example, from Japanese Patent Application Laid-open No. 9-228858, Specification of U.S. Pat. No. 4,517,931 and the like, and designed so that intake and compression strokes and expansion and exhaust strokes are made different from each other by connecting one end of a control rod to a subsidiary connecting rod, and connecting the other end thereof to a pivot shaft rotated about an eccentric axis by a power transmitted from a crankshaft at a reduction ratio of 1/2.

However, in such a stroke-variable engine, a link mechanism comprises a main connecting rod connected to a piston, a subsidiary connecting rod connected to a crankpin of a crankshaft and connected to the other end of the main connecting rod, and a control rod which is connected at one end to the subsidiary connecting rod at a position offset from a connected position of the main connecting rod and connected at the other end thereof to a pivot shaft; and performs a motion of one cycle in two rotations of the crankshaft. Therefore, a 0.5-order inertial vibration is generated, and when a vibrating force provided by the 0.5-order inertial vibration is increased, the following problem is provided:

With an increase in inertial vibration due to an excessively large inertial force, the vibration of the engine is increased and noise due to the vibration is generated. Therefore, there is a need for a measure for avoiding a reduction in strength of engine components due to the excessively large inertial force. Further, mountability of the engine to a working machine is deteriorated due to the excessively large inertial force.

SUMMARY OF THE INVENTION

Accordingly, it is an object of the present invention to provide a stroke-variable engine wherein 0.5-order vibration generated in a subsidiary connecting rod is lowered.

In order to achieve the above object, according to a first feature of the present invention, there is provided a stroke-variable engine comprising: a main connecting rod connected at one end to a piston through a piston pin; a subsidiary connecting rod which is connected to a crankpin of a crankshaft rotatably supported in a crankcase of an engine body and which is connected to the other end of the main connecting rod; a control rod connected at one end to the subsidiary connecting rod at a position offset from a connected position of the main connecting rod; and a pivot shaft which is rotated about an eccentric axis by a power transmitted at a reduction ratio of 1/2 from the crankshaft and to which the other end of the control rod is connected, wherein a position of a center of gravity of the subsidiary connecting rod is determined so that a distance between the position of the center of gravity of the subsidiary connecting rod and an axis of the crankpin is smaller than a distance between a point of connection of the main connecting rod to the subsidiary connecting rod and the position of the center of gravity as well as a distance between a point of connection of the control rod to the subsidiary connecting rod and the position of the center of gravity.

With the first feature, the distance between the position of the center of gravity of the subsidiary connecting rod and the axis of the crankpin is determined to be smaller than the distance between the point of connection of the main connecting rod to the subsidiary connecting rod and the position of the center of gravity as well as the distance between the point of connection of the control rod to the subsidiary connecting rod and the position of the center of gravity. As a result, the position of the center of gravity of the subsidiary connecting rod is disposed closer to the axis of the crankpin, and thus it is possible to suppress the 0.5-order inertial vibration generated in the subsidiary connecting rod, thereby suppressing engine vibration and suppressing noise generated with the vibration.

According to a second feature of the present invention, in addition to the first feature, the subsidiary connecting rod comprises a subsidiary connecting rod body to which the main connecting rod and the control rod are connected, and a cap mounted to the subsidiary connecting rod body with the crankpin interposed therebetween; and a density of a material forming the cap is set to be higher than that of a material forming the subsidiary connecting rod body.

With the second feature, an inertial vibration load on the subsidiary connecting rod is decreased by decreasing the weight of the subsidiary connecting rod body constituting the subsidiary connecting rod in cooperation with the cap, and thus the 0.5-order vibration load is decreased by the arrangement where the position of the center of gravity is disposed closer to the axis of the crankpin, thereby more effectively suppressing the engine vibration and effectively suppressing the noise generated with the vibration.

According to a third feature of the present invention, in addition to the first feature, the subsidiary connecting rod comprises a subsidiary connecting rod body to which the main connecting rod and the control rod are connected, a cap mounted to the subsidiary connecting rod body with the crankpin interposed therebetween, and a weight member mounted on a side of the cap opposite from the subsidiary connecting rod body.

With the third feature, the position of the center of gravity of the subsidiary connecting rod is disposed closer to the axis of the crankpin by mounting the weight member on the side of the cap opposite from the subsidiary connecting rod body, and the 0.5-order inertial vibration is further decreased, thereby more effectively suppressing the engine vibration and effectively suppressing the of noise generated with the vibration.

According to a fourth feature of the present invention, in addition to any of the first to third features, the subsidiary connecting rod comprises a subsidiary connecting rod body to which the main connecting rod and the control rod are connected, and a cap mounted to the subsidiary connecting rod body with the crankpin interposed therebetween; and a density of a material forming the fastening member is set to be higher than that of a material forming the subsidiary connecting rod body.

With the fourth feature, the position of the center of gravity of the subsidiary connecting rod is disposed closer to the axis of the crankpin by increasing the density of the material for forming the fastening member, and the 0.5-order inertial vibration is further decreased, thereby more effectively suppressing the engine vibration and effectively suppressing the of noise generated with the vibration.

The above and other objects, features and advantages of the invention will become apparent from the following description of the preferred embodiment taken in conjunction with the accompanying drawings.

BRIEF DESCRIPTION OF THE DRAWINGS

FIGS. 1 to 5 show a first embodiment of the present invention wherein

FIG. 1 is a vertical sectional side view of an engine;

FIG. 2 is a graph showing variations in vibration components due to a variation in crank angle;

FIG. 3 is a graph showing a proportion in a total vibrating force occupied by each of a plurality of order components;

FIG. 4 is a graph showing variations in inertial force according to a variation in distance between the position of a center of gravity of a subsidiary connecting rod and an axis of a crankpin; and FIG. 5 is a side view of the subsidiary connecting rod.

Figure 1:
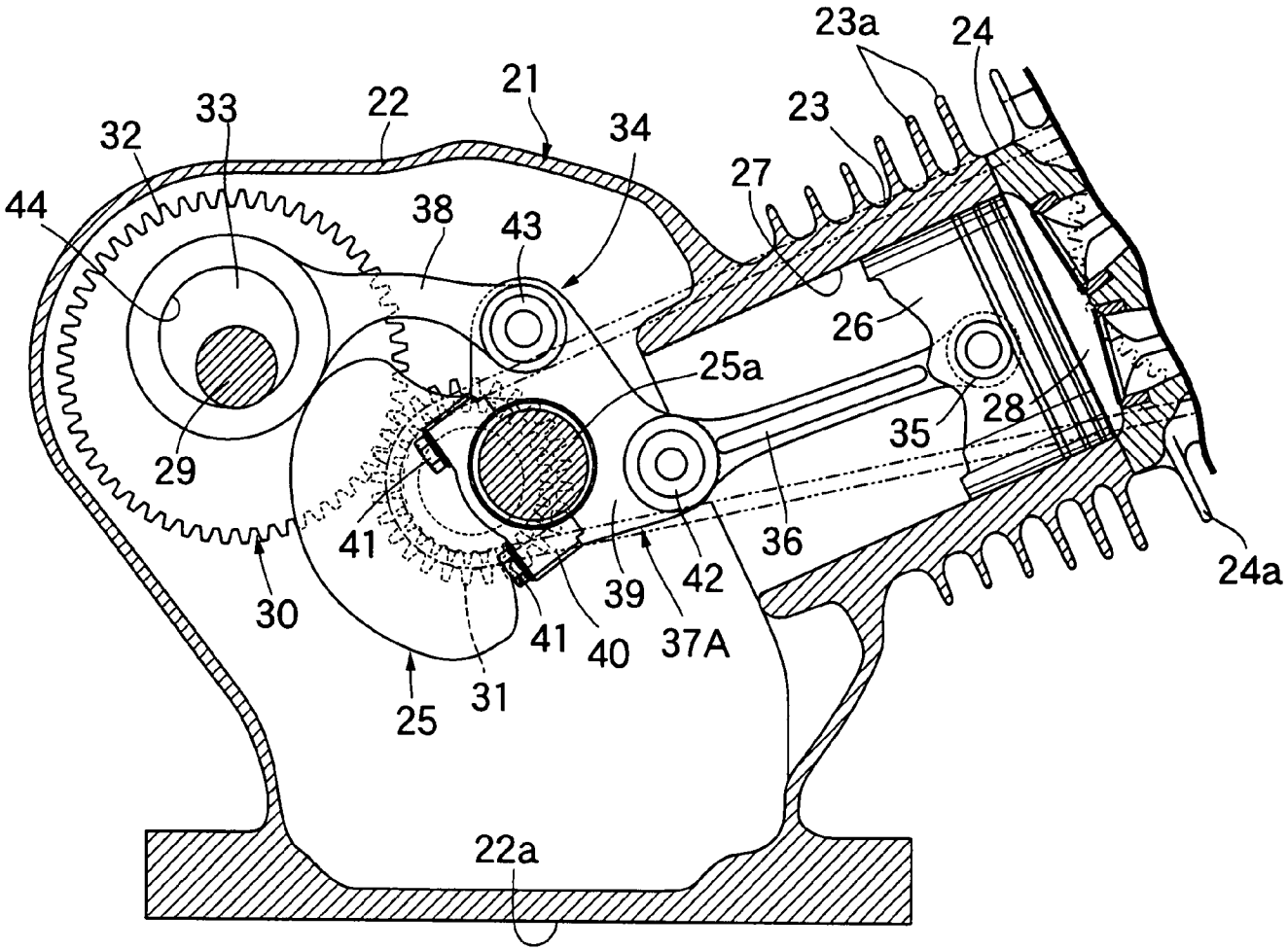

Referring first to FIG. 1, an engine is an air-cooled single-cylinder engine used, for example, in a working machine or the like, and has an engine body 21 which comprises: a crankcase 22; a cylinder block 23 slightly inclined upwards and protruding from one side of the crankcase 22; and a cylinder head 24 coupled to a head of the cylinder block 23. A large number of air-cooling fins 23*a* and 24*a* are provided on outer surfaces of the cylinder block 23 and the cylinder head 24. The crankcase 22 is installed on a cylinder head of any working machine via an installation surface 22*a* of its lower face.

A crankshaft 25 integrally provided with a crankpin 25*a* is rotatably carried in the crankcase 22. The cylinder block 23 has a cylinder bore 27 formed therein so that a piston 26 is slidably received in the cylinder bore 27. A combustion chamber 28 is formed between the cylinder block 23 and the cylinder head 24 so that a top of the piston 26 faces the combustion chamber 28.

A rotating shaft 29 is rotatably carried in the crankcase 22, and has an axis parallel to the crankshaft 25 and a rotational axis above an axis of the crankshaft 25. A rotating shaft-driving means 30 comprises a driving gear 31 fixed to the crankshaft 25 and a driven gear 32 integrally provided on the rotating shaft 29 so as to be meshed with the driving gear 31, and is mounted between the rotating shaft 29 and the crankshaft 25, so that the rotational power of the crankshaft 25 is transmitted at a reduction ratio of 1/2 to the rotating shaft 29.

The rotating shaft 29 is integrally provided with a pivot shaft 33 having an axis at a position eccentric from the axis of the rotating shaft 29. The pivot shaft 33, the piston 26 and the crankshaft 25 are connected to one another through a link mechanism 34.

The link mechanism 34 comprises: a main connecting rod 36 connected at one end thereof to the piston 26 through a piston pin 35; a subsidiary connecting rod 37A connected to a crankpin 25*a* of the crankshaft 25 and connected to the other end of the main connecting rod 36; and a control rod 38 which is connected at one end thereof to the subsidiary connecting rod 37A at a position offset from the connected position of the main connecting rod 36, and to which the other end of the pivot shaft 33 is connected.

The subsidiary connecting rod 37A comprises: a subsidiary connecting rod body 39 formed to come into sliding contact with one half of a periphery of the crankpin 25*a*; and a cap 40 which is in sliding contact with the remaining half of the periphery of the crankpin 25*a* and which is fastened to the subsidiary connecting rod body 39 by bolts 41, 41 which are a pair of fastening members.

The main connecting rod 36 is turnably connected at the other end thereof to one end of the subsidiary connecting rod body 39 of the subsidiary connecting rod 37A through a first pin 42. The control rod 38 is turnably connected at one end thereof to the other end of the subsidiary connecting rod body 39 of the subsidiary connecting rod 37A through a second pin 43, and has a circular shaft bore 44 provided at the other end thereof, into which the pivot shaft 33 is relatively slidably fitted.

As the pivot shaft 33 is rotated at a reduction ratio of 1/2 about the axis of the rotating shaft 29 in response to the rotation of the crankshaft 25, the link mechanism 34 is operated to increase the stroke of the piston 26 at an expansion stroke to a level larger than the stroke of the piston at a compression stroke, whereby a larger expansion work is conducted with the same amount of a fuel-air mixture drawn. In this manner, a cycle thermal efficiency can be enhanced.

Figure 2:
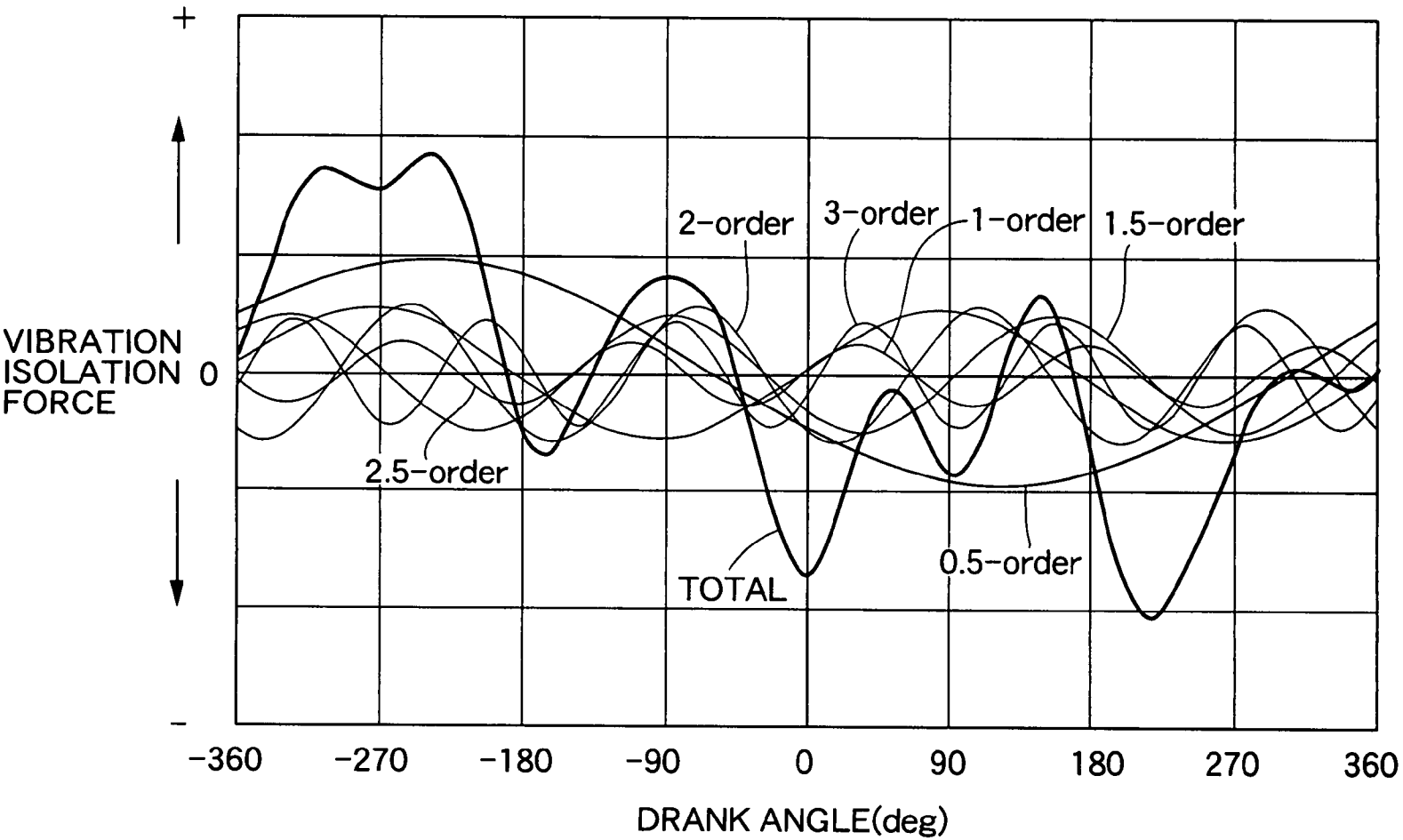

The link mechanism 34 performs a motion of one cycle in two rotations of the crankshaft 25. Therefore, as shown in FIG. 2, an inertial force generated comprises a large number of order components including a 0.5-order inertial vibration. Among the order components, a 0.5-order vibration component is dominant, as shown in FIG. 3.

Figure 3:
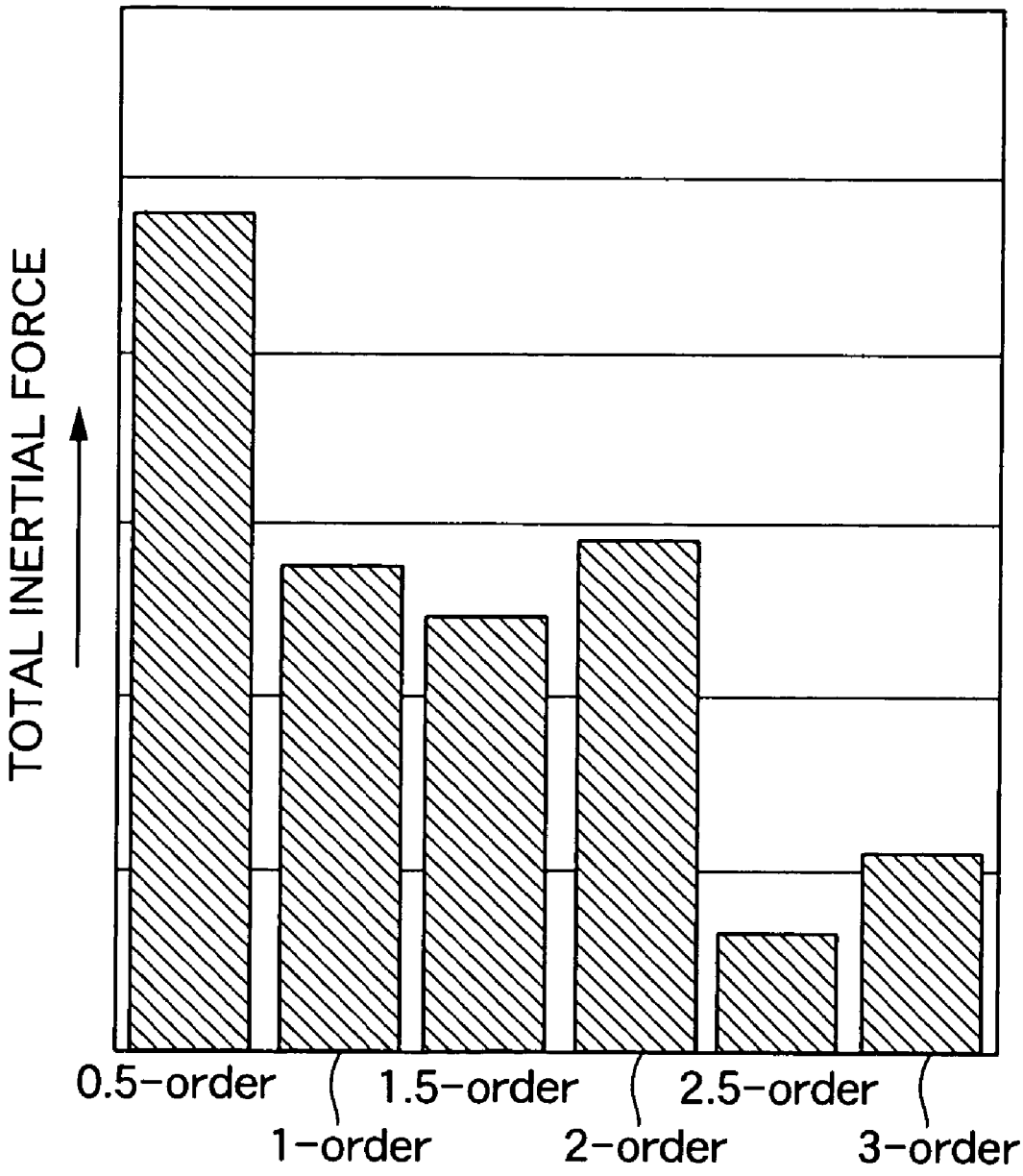
Figure 4:
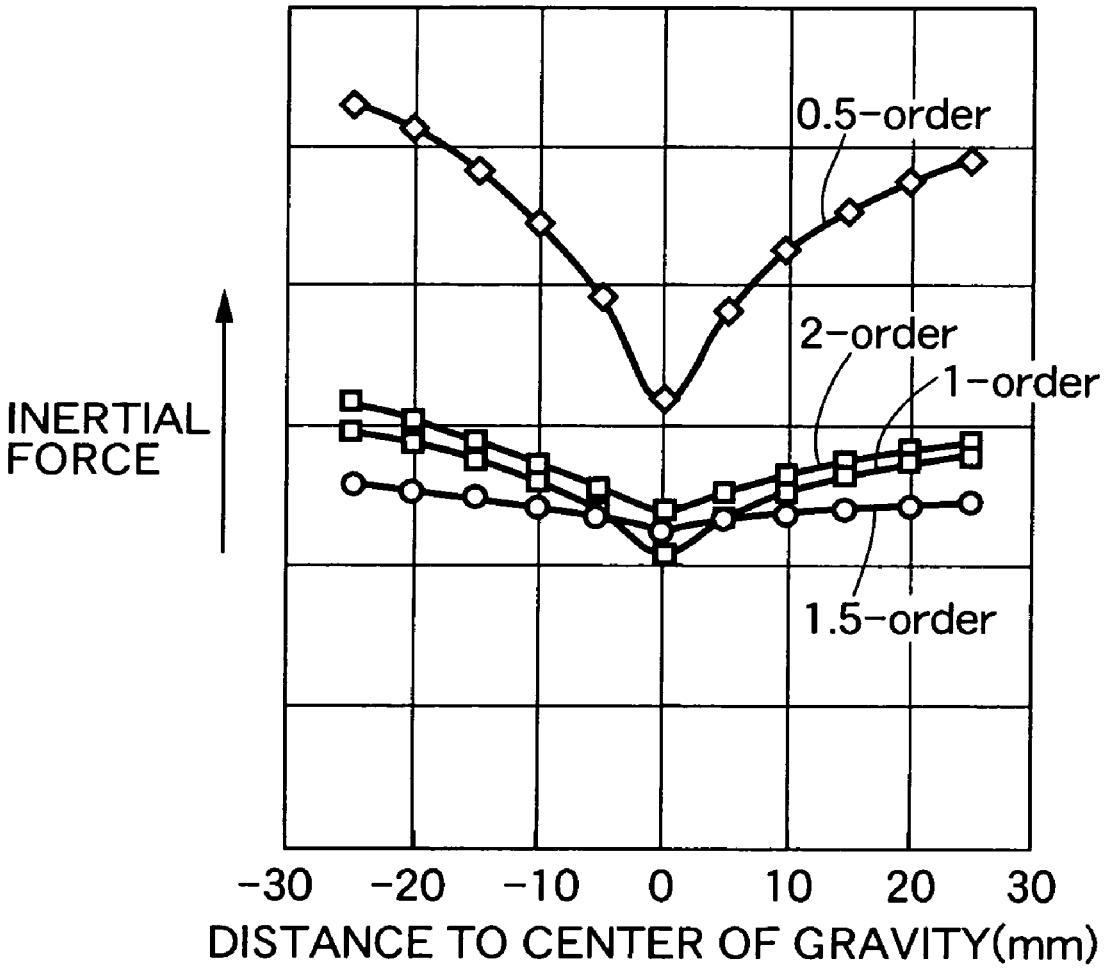

With such a result shown in FIGS. 2 and 3, it can be seen that the inertial vibration can be reduced by decreasing the 0.5-order vibration component, and the 0.5-order vibration component can be remarkably decreased by arranging the position C of the center of gravity of the subsidiary connecting rod 37A closer to the axis of the crankpin 25*a* of the crankshaft 25. Namely, as shown in FIG. 5, it can be seen that the more a distance (which is shown as "DISTANCE TO CENTER OF GRAVITY") between the position C of the center of gravity of the subsidiary connecting rod 37A and the axis of the crankpin 25*a* nears "0", the more the inertial force of each order component is decreased, and particularly the 0.5-order component is remarkably decreased.

Figure 5:
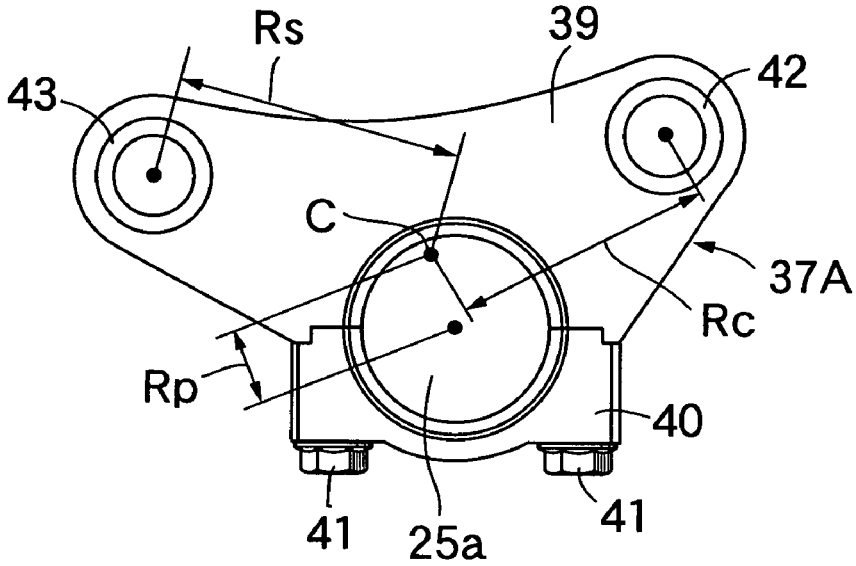

Referring to FIG. 5, according to the present invention, to cause the distance Rp between the position C of the center of gravity of the subsidiary connecting rod 37A and the axis of the crankpin 25*a* to near "0", the position C of the center of gravity is determined so that the distance Rp between the position C of the center of gravity of the subsidiary connecting rod 37A and the axis of the crankpin 25*a* is smaller than a distance Rc between a point of connection of the main connecting rod 36 to the subsidiary connecting rod 37A, i.e., the axis of the first pin 42 and the position C of the center of gravity as well as a distance Rs between a point of connection of the control rod 38 to the subsidiary connecting rod 37A, i.e., the axis of the second pin 43 and the position C of the center of gravity.

Moreover, it is preferable that the position C of the center of gravity situates at a point closer to the cap 40 than closer to the subsidiary connecting rod body 39 in which a sectional secondary moment is larger, in order to connect the main connecting rod 36 and the control rod 38 to each other. In this case, the magnitude of the inertial force of the entire subsidiary rod 37A can be decreased.

In the first embodiment, the density of a material forming the cap 40 is set to be higher than that of a material forming the subsidiary connecting rod body 39. When the subsidiary connecting rod body 39 is formed by die-casting from a light metal such as an aluminum alloy, and the cap 40 is formed from an iron-based material.

The operation of the first embodiment will be described below. The position C of the center of gravity of the subsidiary connecting rod 37A is determined so that the distance Rp between the position C of the center of gravity of the subsidiary connecting rod 37A and the axis of the crankpin 25*a* is smaller than the distance Rc between the point of connection of the main connecting rod 36 to the subsidiary connecting rod 37A and the position C of the center of gravity as well as the distance Rs between the point of connection of the control rod 38 to the subsidiary connecting rod 37A and the position C of the center of gravity.

Such determination of the position C of the center of gravity results in that the position C of the center of gravity of the subsidiary connecting rod 37A is disposed to be closer to the axis of the crankpin 25*a*. Thus, the 0.5-order inertial vibration produced in the subsidiary connecting rod 37A can be suppressed, whereby the engine vibration can be suppressed, and the noise generated with the vibration can be suppressed.

Moreover, the subsidiary connecting rod 37A comprises the subsidiary connecting rod body 39 to which the main connecting rod 36 and the control rod 38 are connected, and the cap 40 fastened to the subsidiary connecting rod body 39 with the crankpin 39 interposed therebetween. The density of the material forming the cap 40 is set to be higher than the density of the material forming the subsidiary connecting rod body 39. Therefore, by reducing the weight of the subsidiary connecting rod body 39, the inertial vibration load on the subsidiary connecting rod body 39 is decreased. Thus, by virtue of the arrangement that the position C of the center of gravity is disposed to be closer to the axis of the crankpin 25*a*, the 0.5-order inertial vibration load is decreased, thereby more effectively suppressing the engine vibration and effectively suppressing the noise generated with the vibration.

Figure 6:
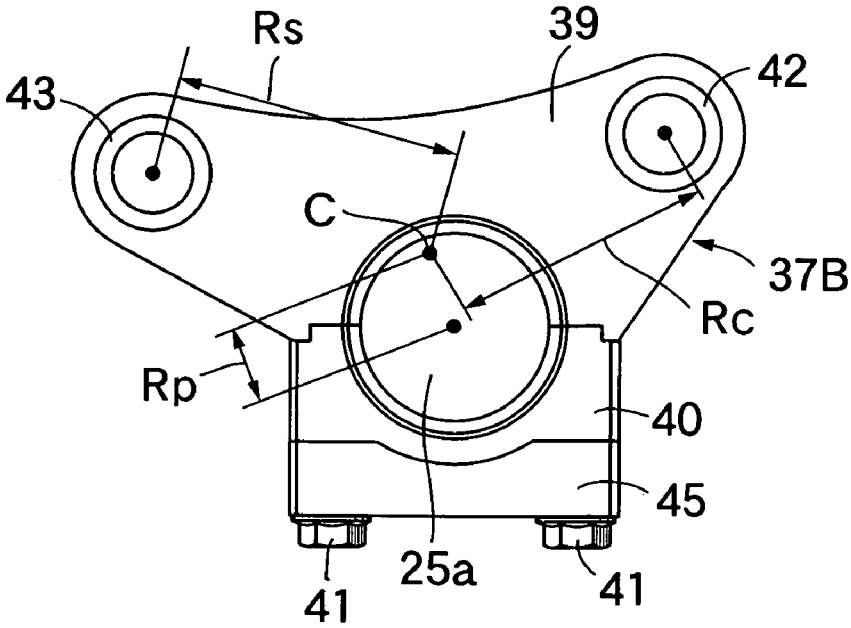
FIG. 6 is a side view of a subsidiary connecting rod in a second embodiment.

FIG. 6 shows a subsidiary connecting rod according to a second embodiment. The subsidiary connecting rod 37B comprises: a subsidiary connecting rod body 39; a cap 40 mounted to the subsidiary connecting rod body 39 with a crankpin 25*a* interposed therebetween; and a weight member 45 mounted on a side of the cap 40 opposite from the subsidiary connecting rod body 39. The cap 40 and the weight member 45 are fastened together by bolts 41, 41 which are a pair of fastening members. Moreover, each of the subsidiary connecting rod body 39 and the cap 40 is formed of a light metal material such as an aluminum alloy, while each of the weight member 45 and the bolts 41 is formed of a material having a density higher than that of the light metal material, for example, an iron-based material.

As in the first embodiment, the position C of a center of gravity of the subsidiary connecting rod 37B is determined so that a distance Rp between the position C of the center of gravity of the subsidiary connecting rod 37B and an axis of a crankpin 25*a* is smaller than a distance Rc between a point of connection of a main connecting rod 36 to the subsidiary connecting rod 37B, i.e., an axis of a first pin 42 and the position C of the center of gravity as well as a distance Rs between a point of connection of a control rod 38 to the subsidiary connecting rod 37B, i.e., an axis of a second pin 43 and the position C of the center of gravity.

According to the second embodiment, the position of the center of gravity of the subsidiary connecting rod 37B can be arranged closer to the axis of the crankpin 25*a* by mounting the weight member 45 on the side of the cap 40 opposite from the subsidiary connecting rod body 39; and the 0.5-order inertial vibration is further decreased, thereby more effectively suppressing the engine vibration and effectively suppressing the noise generated with the vibration.

In the second embodiment, a plurality of weight members 45 may be mounted in a superposing manner on the cap 40.

According to a yet further embodiment of the present invention, in a subsidiary connecting rod 37A having the same structure as in the first embodiment, the density of a material forming a bolt 41 may be set to be higher than that of a material forming each of a subsidiary connecting rod body 39 and a cap 40. For example, each of the subsidiary connecting rod body 39 and the cap 40 may be formed of a light metal material such as an aluminum alloy, and the bolt 41 may be formed of an iron-based material. In addition, the density of a material forming each of the cap 40 and the bolt 41 may be set to be higher than that of a material forming the subsidiary connecting rod body 39. For example, the subsidiary connecting rod body 39 may be formed of a light metal material such as an aluminum alloy, and each of the cap 40 and the bolt 41 may be formed of an iron-based material.

Also with this arrangement, the position of a center of gravity of the subsidiary connecting rod 37A can be arranged closer to an axis of a crankpin 25*a*, and by further decreasing the 0.5-order inertial vibration, the engine vibration can be more effectively suppressed, and also the noise generated with the vibration can be effectively suppressed.

Although the embodiments of the present invention have been described, that the present invention is not limited to the above-described embodiments, and various modifications in design can be made without departing from the scope of the present invention defined in claims.

What is claimed is:

1. A stroke-variable engine comprising:

a main connecting rod connected at one end to a piston through a piston pin;

a subsidiary connecting rod which is connected to a crankpin of a crankshaft rotatably supported in a crankcase of an engine body and which is connected to the other end of the main connecting rod;

a control rod connected at one end to the subsidiary connecting rod at a position offset from a connected position of the main connecting rod; and a pivot shaft which is rotated about an eccentric axis by a power transmitted at a reduction ratio of 1/2 from the crankshaft and to which the other end of the control rod is connected, wherein a position of a center of gravity of the subsidiary connecting rod is determined so that a distance between the position of the center of gravity of the subsidiary connecting rod and an axis of the crankpin is smaller than a distance between a point of connection of the main connecting rod to the subsidiary connecting rod and the position of the center of gravity as well as a distance between a point of connection of the control rod to the subsidiary connecting rod and the position of the center of gravity, wherein the subsidiary connecting rod comprises:

a subsidiary connecting rod body to which the main connecting rod and the control rod are connected, a cap mounted to the subsidiary connecting rod body with the crankpin interposed therebetween, and a weight member mounted on a side of the cap opposite from the subsidiary connecting rod body, wherein the cap is disposed completely between the weight member and the subsidiary connecting rod body, and wherein a density of a material forming the weight member is greater than a density of a material forming the subsidiary connecting rod body to reduce a vibration generated in the subsidiary connecting rod by an order of 0.5.

2. A stroke-variable engine comprising:

a main connecting rod connected at one end to a piston through a piston pin;

a subsidiary connecting rod which is connected to a crankpin of a crankshaft rotatably supported in a crankcase of an engine body and which is connected to the other end of the main connecting rod;

a control rod connected at one end to the subsidiary connecting rod at a position offset from a connected position of the main connecting rod; and a pivot shaft which is rotated about an eccentric axis by a power transmitted at a reduction ratio of 1/2 from the crankshaft and to which the other end of the control rod is connected, wherein a position of a center of gravity of the subsidiary connecting rod is determined so that a distance between the position of the center of gravity of the subsidiary connecting rod and an axis of the crankpin is smaller than a distance between a point of connection of the main connecting rod to the subsidiary connecting rod and the position of the center of gravity as well as a distance between a point of connection of the control rod to the subsidiary connecting rod and the position of the center of gravity, wherein the subsidiary connecting rod comprises:

a subsidiary connecting rod body to which the main connecting rod and the control rod are connected, a cap mounted to the subsidiary connecting rod body with the crankpin interposed therebetween, wherein a density of a material forming the cap is greater than a density of a material forming the subsidiary connecting rod body to reduce a vibration generated in the subsidiary connecting rod by an order of 0.5.

* * * * *